US007777145B2

(12) United States Patent
Burrell et al.

(10) Patent No.: US 7,777,145 B2
(45) Date of Patent: Aug. 17, 2010

(54) TOGGLE-STYLE DIMMER APPARATUS AND METHOD

(76) Inventors: Douglas Burrell, 982 N. 400 West, #B, American Fork, UT (US) 84003; David Clare, 9521 S. Orton Rd., Salem, UT (US) 84653

( * ) Notice: Subject to any disclaimer, the term of this patent is extended or adjusted under 35 U.S.C. 154(b) by 381 days.

(21) Appl. No.: 12/027,197

(22) Filed: Feb. 6, 2008

(65) Prior Publication Data

US 2009/0159415 A1 Jun. 25, 2009

Related U.S. Application Data

(60) Provisional application No. 61/015,667, filed on Dec. 21, 2007.

(51) Int. Cl.
*H01H 9/00* (2006.01)

(52) U.S. Cl. ..... 200/330; 200/331

(58) Field of Classification Search ..... 200/1 B, 200/17 R, 18, 330–332, 556, 553, 339; 174/66, 174/67; 307/157, 139–141, 112, 125; 323/905
See application file for complete search history.

(56) References Cited

U.S. PATENT DOCUMENTS

| | | | | |
|---|---|---|---|---|
| 4,654,626 | A | 3/1987 | Carsello | |
| 4,835,343 | A | 5/1989 | Graef et al. | |
| 5,207,317 | A * | 5/1993 | Bryde et al. | 200/457 |
| 5,290,983 | A * | 3/1994 | Roberts et al. | 200/557 |
| 5,319,283 | A | 6/1994 | Elwell | |
| 5,359,231 | A | 10/1994 | Flowers et al. | |
| D356,999 | S | 4/1995 | Alcocer | |
| D364,141 | S | 11/1995 | Hanna et al. | |
| 5,637,930 | A | 6/1997 | Rowen et al. | |
| 6,005,308 | A | 12/1999 | Bryde et al. | |
| 6,744,582 | B2 | 6/2004 | Shimoda et al. | |
| 6,891,117 | B1 * | 5/2005 | Gouhl et al. | 200/339 |
| D518,446 | S | 4/2006 | Hedderich et al. | |
| 7,170,018 | B2 * | 1/2007 | Ilkhanov | 200/18 |
| 7,265,308 | B2 * | 9/2007 | Endres et al. | 200/339 |
| 7,285,723 | B2 * | 10/2007 | Lindenstraus et al. | 174/66 |
| 7,335,845 | B2 * | 2/2008 | Johnsen et al. | 200/332 |

(Continued)

OTHER PUBLICATIONS

Smarthome, *INSTEON ToggleLinc Dimmer, White*, Jul. 31, 2007, pp. 1-4, http://www.smarthome.com/2466dw.html.

(Continued)

*Primary Examiner*—Michael A Friedhofer
(74) *Attorney, Agent, or Firm*—Pate Pierce & Baird

(57) ABSTRACT

A switch for controlling delivery of electrical current to a light. The switch may include a frame, a controller connected to the frame, and a toggle connected to the frame to pivot through a range of motion having a first extreme and a second extreme, opposite the first extreme. The toggle may toggle between a first position proximate the first extreme and a second position proximate the second extreme. The switch may further include a sensor connected to the frame and positioned to detect the toggle in the second position, and a tactile switch connected to the frame and positioned to be actuated by the toggle pivoting past the first position toward the first extreme. The switch may also include a controller connected to the sensor and tactile switch to receive inputs therefrom and to execute logic to control the delivery in accordance with the inputs.

18 Claims, 12 Drawing Sheets

U.S. PATENT DOCUMENTS 7,365,282 B2 * 4/2008 Altonen et al. ..... 200/331
7,400,239 B2 * 7/2008 Kiko et al. ..... 340/501
7,449,632 B2 * 11/2008 Wang ..... 174/53
7,667,155 B1 * 2/2010 Ni et al. ..... 200/556
2007/0176714 A1 * 8/2007 Potempa et al. ..... 335/1

OTHER PUBLICATIONS

Smarthome, *ICON Dimmer Switch*, Jul. 31, 2007, pp. 1-5, http://www.smarthome.com/2876db.html.

* cited by examiner

TOGGLE-STYLE DIMMER APPARATUS AND METHOD

RELATED APPLICATIONS

This application claims the benefit of U.S. Provisional Patent Application Ser. No. 61/015,667 filed Dec. 21, 2007.

BACKGROUND

1. The Field of the Invention

This invention relates to electrical switches and, more particularly, to novel systems and methods for dimmer switches.

2. The Background Art

Incandescent lights operate by heating a filament with electrical current until the filament glows, typically white or nearly so in many applications. Typically, lights have a rating of power consumption (e.g., wattage) and light output (e.g., lumens, candlepower, etc.). Controlling the level of light emitted by a particular unit (e.g., light bulb) may be done by controlling the current passed through the filament.

To control ambiance, mood, or the like, a user may rely on a dimmer to set the power or current delivery to a light, thus setting the amount of light output by a light or array of lights. As controllers have developed for "dimming" lights, a host of switches, underlying mechanisms, electrical circuits, and electronic logic have been brought to bear on the issue.

Such "dimmers" have traditionally been in one of two categories, comparatively expensive, and exorbitantly expensive. Dimmers at the lower end of the cost spectrum are typically still much more expensive than simple switches, often by an order of magnitude or more.

The lower end dimmers, moreover, are usually comparatively complex, involving many small and interrelated parts, both electrical and mechanical. Accordingly, durability is often poor as the weakest link fails. Each dimmer is usually isolated to its own one location, due to cost or functionality. Thus, multiple switchplates in a room often cannot host dimmers equally effective to dim lights in a room. Many dimmers are inconvenient, and may include multiple actuators that must be used for functions such as on-off versus dimming. Many cannot stay at a preset dimmed value and still actuate an on-off switch, returning to the preset position whenever turned on. Many are not easily adjusted. The designs associated with dimmers are typically unique, compared to the other switches from the same manufacturer or supplier. This uniqueness renders them uniquely unfashionable or even unsightly.

On the other hand, high-end dimmers have often become, effectively, computer-controlled power distribution systems. Virtually any logical algorithm can be programmed into a computer. Meanwhile, relays will permit low-voltage circuits, outputting signals from the logic of a computer, to be amplified to higher voltages, currents, or both. Thus, by applying enough processing and relay amplification, a household may light a dim display or a veritable stadium. However, these systems can represent a significant fraction of the cost of a building or residence.

What is needed is a dimming system that is mechanically simple, durable, electrically simple and robust, that provides a dimming function and an on-off function on a single actuator operable intuitively by a user. What is needed is a system providing all the desirable functionality of dimming and on-off switches in a mechanical system that looks and operates like every other on-off switch of its design type. In one sense, a switch is needed that does not scream out to a viewer that it is a cobbled set of switches, slides, paddles, toggles, buttons, or the like—different from every other switch in the room or the house. Also needed is a simple, economical dimmer switch that costs less than one order of magnitude more than the cost of a simple, on-off switch.

If a clean, simple, functional presentation is available for a system of switches, it would be an advance in the art to provide a dimmer switch that is visually indistinguishable from those other switches. Functionally, it would be an advance to provide such low cost and seamless appearance in a dimmer switch having very sophisticated dimming, cycling, preset levels, automatic undimming and dimming, automatic transition from an "off" state to a preset dimmed state, automatic transition dimming from an "on" state (dimmed or undimmed) to an off state, and the like.

BRIEF SUMMARY OF THE INVENTION

In view of the foregoing, in accordance with the invention as embodied and broadly described herein, a method and apparatus are disclosed in one embodiment of the present invention as including a switch controlling distribution of power to a light. The switch may include a frame with a controller connected to it. A rocker connected to the frame may pivot with respect thereto through a range of motion, extending between two extremes.

A signal generator connected to the frame has a first resistor, providing one value of electrical resistance, while a second resistor provides another different value, distinct from the first resistance. A micro switch may be positioned to be actuated by the rocker pivoting toward the first extreme of motion. A second micro switch is positioned to be actuated by the rocker pivoting toward the second extreme of motion.

The signal generator receives a control current from the controller, which current it directs through the first resistor whenever the first micro switch is activated. If the second micro switch is activated, the current is directed through the second resistor. Thus, the controller receives an input signal corresponding to the resistance (e.g., voltage across the resistor, or the resistance, etc.) imposed by the signal generator. The controller then executes logic to control the distribution of current in accordance with the input signal.

In one embodiment, the controller may include a processor programmed to execute a POWER ON function. The controller may do so after sensing that the resistance imposed by the signal generator corresponds to the first resistor for too short a time. For example, a first time threshold may be established so the POWER ON function is executed if the period of time is less than a first time threshold.

The processor may be programmed to execute a BRIGHTEN function after an extended time. For example, the controller may sense that the resistance imposed by the signal generator corresponds to (e.g., presents a voltage or resistance reflecting or even equaling the first resistance) for a period time greater than a second time threshold. The processor may also execute a POWER OFF function after the controller senses that the resistance imposed by the signal generator has been substantially equal to the second resistance for a period time less than the first time threshold.

The first and second time thresholds may be equal, or nearly so, but need not be. Also, the POWER ON function may return the distribution of current to that corresponding to the state existing immediately prior to execution of the last, previous, POWER OFF function. The processor may also execute a DIM function. For example, this may occur after the controller senses that the resistance imposed by the signal generator corresponds to the second resistance and persists longer than the second time threshold.

In some embodiments, the first, second, or both micro switches may be of a push-to-make type. Either or each may be actuated by the rocker effecting closure thereof. The first, second, or both micro switches may include a biasing mechanism. These biasing members may, respectively, bias the rocker away from the first extreme and the second extreme.

The range of motion may include a middle, effectively equidistant from the extremes of motion. Likewise, the first and second micro switches may collectively bias the rocker toward the middle.

In certain embodiments, a system in accordance with the invention may control distribution of current to a light by using a master switch and a slave switch. Each may include a rocker connected to a single frame to pivot with respect thereto. The motion may be linear, rotary, or pivotal through a range between first second extremes, opposite one another A signal generator connected to the frame, may have first and second resistors of respective first and second distinct resistances. Micro switches may be actuated by the rocker as it pivots, respectively toward the first and second extremes.

The master may include a controller, while the signal generators of the master and slave connect in parallel to form a controlling circuit. Connecting the signal generators of the master and slave to receive a current from the controller, through the control circuit, directs the control current. The control current is directed through the first resistor upon activation of the first micro switch and through the second resistor upon activation of the second micro switch. The controller, meanwhile, receives an input signal corresponding to the resistance of the control circuit. The value of resistance detected then controls execution of logic to control the distribution of current.

In one embodiment, a switch controlling delivery of electrical current to a light may include a frame, having a controller and toggle connected thereto. The toggle may pivot through a range of motion between opposite extremes. However, in certain embodiments it may toggle exclusively between positions near the extremes, rather than at the extremes.

For example, a sensor may detect the toggle in a second position. Meanwhile, a "tactile switch" on the frame may be actuated by the toggle pivoting past a first position toward a first of the extremes. Likewise, the controller connected to the sensor and tactile switch may receive inputs therefrom and execute logical instructions (e.g., code) to control delivery of current to the lights.

The controller may typically include a processor programmed to execute a POWER ON function whenever the sensor senses that the toggle has toggled out of a second position and a POWER OFF function whenever the sensor senses that the toggle has toggled into the second position. The POWER ON function may include delivery of current at a second value corresponding to a second state, existing immediately prior to the controller executing the last, previous, POWER OFF function.

The processor may execute a DIM function upon activation of the tactile switch in order to progressively alter delivery of current, repeatedly cycling between a maximum and minimum value. Typically, the controller may exit the DIM function upon deactivation of the tactile switch. The processor may maintain current at a first value corresponding to a first state existing immediately prior to the controller exiting the last, previous, DIM function.

In one embodiment, the sensor detects the presence of the toggle in the second position without contacting the toggle. For example, the sensor may be a magnetic switch, optical switch, or the like. A tactile switch may be of a push-to-make type. However, it may also include, for added safety, an air gap switch, which may be opened when no current is flowing, thus avoiding drawing an arc. The air gap switch may connect to the frame, being actuated by the toggle pivoting past the second position and toward the second extreme. It may be of a push-to-break type.

Typically, the controller, including a processor programmed to execute a DIM function, does so upon activation of the tactile switch. The DIM function may cycle repeatedly between delivery of maximum and minimum current. The processor may also exit the DIM function upon deactivation of the tactile switch. It may maintain distribution at a first value corresponding to a first state existing immediately prior to the controller exiting the last, previous, DIM function.

The POWER ON function in these embodiments may include returning to a second state selected to be that state existing immediately prior to the controller executing the last, previous, POWER OFF function.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE INVENTION

Figure 1:
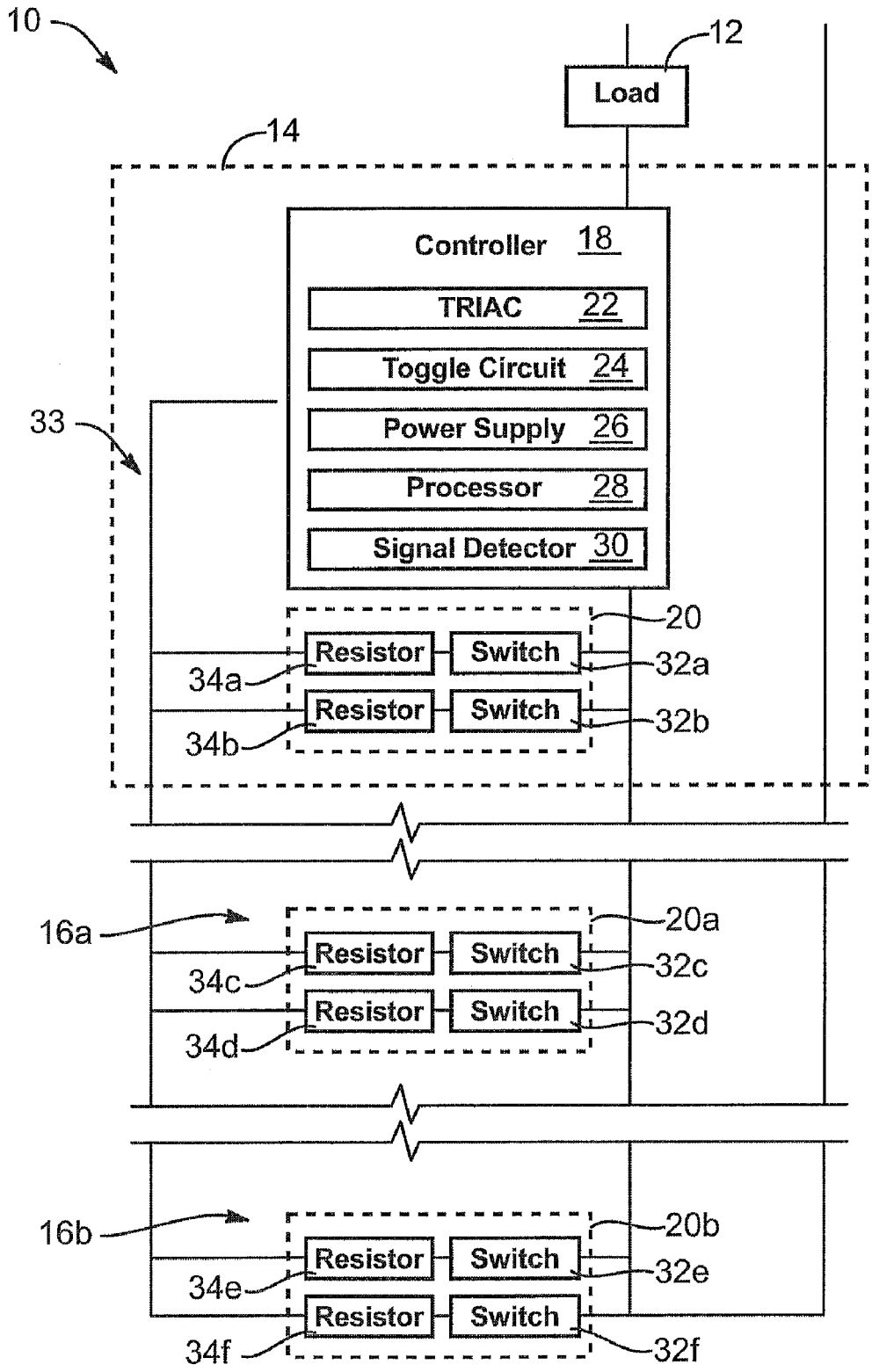
FIG. 1 is a schematic block diagram illustrating one embodiment of system in accordance with the present invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments consistent with the invention. The illustrated embodiments of the invention will be best understood by reference to the drawings, wherein like parts are designated by like numerals throughout.

Referring to FIG. 1, a system 10 in accordance with the present invention may provide a "dimmer" for a load 12 (e.g., one or more lights 12). While "dimming" taken literally may mean decreasing the intensity of light, a dimmer is a term of art applied to devices capable of increasing and decreasing the intensity of the output of a light 12. In selected embodiments, a system 10 may operate by increasing or decreasing the power delivered to a light 12.

In certain embodiments, a system 10 may include a master switch 14. A master switch 14 may actually control the delivery of power to a light 22 connected thereto. If desired, a system 10 may also include one or more slave switches 16. A slave switch 16 may connect to a master switch 14 and provide an additional location at which a user may input commands. The commands may then be passed to the master switch 14 for implementation.

In selected embodiments, a master switch 14 may include a controller 18 and a signal generator 20. A signal generator 20 may receive inputs or commands from a user and generate an identifiable electrical signal corresponding thereto. A controller 18 may receive that signal, translate or decode it, and act on it in a manner suitable to effect the dimming function.

In certain embodiments, a controller 18 may include a Triode for Alternating Current (TRIAC) 22. In general, a TRIAC 22 may be an electrical component acting as two silicon-controlled rectifiers (SCR) joined in inverse parallel and with connected gates. Accordingly, a TRIAC may provide a bi-directional electronic switch.

A TRIAC 22 may be triggered by a positive or negative voltage. Once triggered, a TRIAC 22 may conduct current until the current fails below a selected threshold. Thus, a TRIAC 22 may be suitable for controlling a relatively large power flow using a relatively smaller power flow. Also, by applying a trigger pulse, the percentage of current flowing through a TRIAC 22 to a load 12 may be controlled. In certain embodiments, a controller 18 may also include a toggle circuit 24. A toggle circuit 24 may control the triggering current delivered to a TRIAC 22.

In selected embodiments, a controller 18 may also include a power supply 26, processor 28, and signal detector 30 or signal decoder 30. A power supply 26 may condition and prepare the electrical power for consumption by the other devices of the controller 18. For example, a power supply 26 may convert a portion of the alternating current supplied thereto into a direct current at a lower voltage, more suitable for devices like the processor 28, signal generator 20, and the like.

A signal detector 30 may receive the output or monitor the output of the signal generator 20. The signal detector 30 may translate that output into a form recognizable by the processor 28. Upon receiving the output from a signal detector 30, a processor 28 may act on or execute logic defining the desired operation of the system 10. Logic may define adjustments in the power generated by the toggle circuit 24 and delivered to the TRIAC 22, which in turn may modulate the power flowing to the load 12.

A signal generator 20 may include a plurality of switches 32. For example, in one embodiment, a signal generator 20 may include a first micro switch 32*a* and a second micro switch 32*b*. A micro switch 32 in accordance with the present invention may be an electrical switch actuated by a relatively small force. Inside certain micro switches 32, a relatively small movement by an actuator may produce a relatively large movement at the electrical contacts. When the leads transition to a contacting position, they produce a clicking sound and provide a crisp feel. When the actuator is released, the electrical contacts may spring back to their original shape.

In selected embodiments, a micro switch 32 in accordance with the present invention may be a "push-to-make" switch. That is, the micro switch 32 may be opened until actuated or pushed toward closure. Once the force urging closure is removed, a push-to-make switch may be biased to return to an open configuration.

A signal generator 20 may be electrically connected with a controller 18 through a control circuit 33. Depending upon which switch 32*a*, 32*b* has been actuated, a signal generator 20 may send a different electrical signal through the control circuit 33 to the controller 18. This may be accomplished in any suitable manner.

In certain embodiments, a signal generator 20 may include one or more resistors 34 connected in series with a switch 32. Accordingly, when that switch 32 is actuated, a current applied to the control circuit 33 may pass therethrough and encounter a resistor 34. In accordance with Ohm's law, a resistor 34 may alter the electrical characteristics of the signal generator 20 and control circuit 33 in a predictable manner. That is, the amount of direct current flowing in a circuit is directly proportional to the potential difference (i.e., voltage) and inversely proportional to the resistance of the circuit.

Accordingly, when a switch 32 is open, the resistance may be assumed to be infinite (although the true resistance becomes that of the air gap between the contacts of the switch 32). With what may be considered an infinite resistance, the current flowing through the signal generator 20 (and potentially the control circuit 33) may be substantially zero. However, once a switch 32 is closed, current may flow through the corresponding resistor 34. The resistor 34 may then alter the electrical characteristics (e.g., voltage, resistance, current flow) of the signal generator 20 and control circuit 33, thereby effectively applying a known, characteristic value, an electrical "finger print." A signal detector 30 may monitor a control circuit 33 for that finger print and detect when a switch 32 has been actuated.

For example, in one embodiment, a first resistor 34*a* may be connected in series with a first switch 32*a*. A second resistor 34*b* may be connected in series with a second switch 32*b*. The resistance of the first resistor 34*a* may be different from the resistance of the second resistor 34*b*. When the first switch 32*a* is actuated, current may flow within a control circuit 33 from a controller 18, through the first switch 32*a*, through the first resistor 34*a*, and back to the controller 18.

The resistance, voltage, or current corresponding to the control circuit 33 may be altered in accordance with Ohm's law, based on the resistance of the first resistor 34*a*.

Similarly, when the second switch 32*b* is actuated, current may flow within a control circuit 33 from a controller 18, through the second switch 32*b*, through the second resistor 34*b*, and back to the controller 18. The resistance, voltage, or current corresponding to the control circuit 33 may be altered in accordance with Ohm's law, based on the resistance of the second resistor 34*b*. Accordingly, the electrical characteristics imposed by the different resistances of first and second resistors 34*a*, 34*b* support a controller 18 in decoding the information of which switch 32*a*, 32*b* has been actuated.

A slave switch 16 in accordance with the present invention may include a signal generator 20. In general, the internal workings of the signal generator 20 corresponding to a slave switch 16 may be equivalent to the internal workings of a signal generator 20 corresponding to a master switch 14. Accordingly, the signal generator 20*a* corresponding to a slave switch 16*a* may include first and second switches 32*c*, 32*d* as well as first and second resistors 34*c*, 34*d*.

The signal generator 20*a*, 20*b* of a slave switch 16*a*, 16*b* may be connected in parallel with the signal generator 20 of a master switch 14. The resistances of the various first resistors 34*a*, 34*c*, 34*e* may be substantially equal. Additionally, the resistances of the various second resistors 34*b*, 34*d*, 34*f* may be substantially equal. Thus, in selected embodiments, a controller 18 may be unable to distinguish which signal generator 20, 20*a*, 20*b* altered the electrical flow returning to the controller 18. However, regardless of which switch 32 is actuated, a controller 18 may properly differentiate between actuations of first switches 32*a*, 32*c*, 32*e* and actuation of the second switches 32*b*, 32*c*, 32*f* and may then implement functions based thereon.

In such embodiments, a master switch 14 may operate individually. When additional locations of control are desired, a slave switch 16 may be connected to the master switch 14. Thus, the controller 18 may provide dimmer functionality when a slave switch 16 is actuated or when the master switch 14 itself is actuated. The number of slave switches 16 that may be added to a system 10 in accordance with the present invention is theoretically unlimited. However, due to accumulated changes in resistance, imperfect connections, and the like, it may be beneficial to limit the number of slave switches to a modest, finite number (e.g., ten or less).

Figure 2:
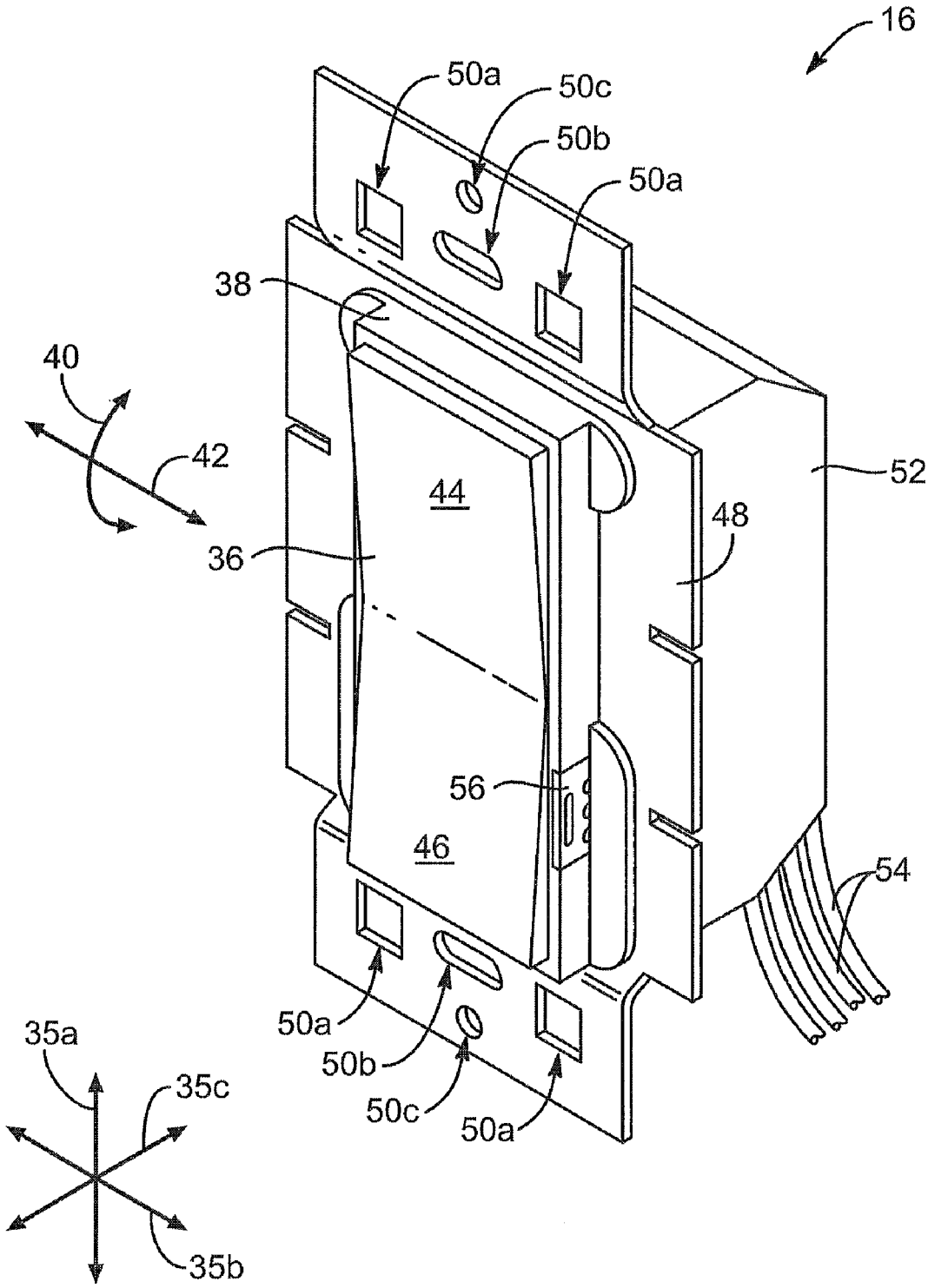
FIG. 2 is a perspective view of one embodiment of a master switch in accordance with the present invention with the rocker in the middle of its range of motion.

Referring to FIG. 2, in discussing further a system 10 in accordance with the present invention, it may be helpful to define a coordinate system. In the illustrated embodiments, a coordinate system may include a longitudinal direction 35*a*, lateral direction 35*b*, and a transverse direction 35*c* substantially orthogonal to one another.

A switch 14, 16 may include a rocker 36 pivotably connected to a frame 38. The connection between a rocker 36 and frame 38 may support pivoting 40 about an axis 42 extending in the lateral direction 35*b*. Accordingly, a user may press a first end 44 of a rocker 36 in the transverse direction 35*c* to input a certain command. Similarly, a user may press a second end 46 of a rocker 36 in the transverse direction 35*c* to implement other commands.

In selected embodiments, a rocker 36 may pivot 40 through a range of motion bounded by a first extreme and a second extreme. The second extreme may be substantially opposite the first extreme. The first extreme of the range of motion may be reached when the first end 44 of the rocker 36 is pressed to or toward a substantially flat orientation with respect to the surrounding frame 38. Conversely, the second extreme of the range of motion may be reached when the second 46 of the rocker 36 is pressed substantially flat with the surrounding frame 38.

In certain embodiments, a user may press and release the first end 44 to provide an "on" command, which may initiate a POWER ON function within the controller 18. A user may press and hold the first end 44 to provide a "brighten" (opposite of dimming) command, which may initiate a BRIGHTEN function within the controller 18. Conversely, a user may press and release the second end 46 to provide an "off" command, which may initiate a POWER OFF function within the controller 18. A user may press and hold the second end 46 to provide a "dim" command, which may initiate a DIM function within the controller 18.

A frame 38 in accordance with the present invention may provide the structure to which the various components of the switch 14, 16 secure or connect. For example, a rocker 36 may connect to the frame 38. Additionally, a flange 48 may connect to a frame 38.

A flange 48 may perform various functions. For example, a flange 48 may provide the interfacing structures necessary to secure the switch 14, 16 to a connection box. Additionally, a flange 48 may provide the interfacing structures necessary to secure a face plate to the switch 14, 16. In selected embodiments, to perform these functions, a flange 48 may include various apertures 50.

For example, in certain embodiments, a flange 48 may include four substantially rectangular apertures 50*a* extending in the transverse direction 35*c* therethrough. These apertures 50*a* may be sized to receive engagement prongs extending from a face plate. Such a face plate and interface system is disclosed in U.S. Pat. No. 7,284,996, issued Oct. 23, 2007 to Brent L. Kidman, incorporate by reference herein. Other apertures 50*b* may receive a fastener extending transversely through the flange 48 to secure the switch 14 to a connection box or to secure an anchor for engaging a connection box. Still other apertures 50*c* may support engagement with conventional, screw-fastened face plates.

In selected embodiments, a flange 48 may provide a heat sink and convective surface for certain electrical components forming the switch 14. For example, while performing a dimming function, a TRIAC 22 may produce heat. It may be necessary or desirable to remove that heat before the temperature of the TRIAC 22 reaches a point where degradation occurs. Accordingly, a TRIAC 22 may be thermally connected to a flange 48.

In certain embodiments, a flange 48 may be formed of a material suitable for conducting heat. Additionally, a flange 48 may have mass and dimensions sufficient to absorb, and dissipate to the surrounding air, the heat received from a TRIAC 22. In selected embodiments, a flange 48 may be formed of aluminum to provide a lightweight heat sink with an acceptable heat transfer (e.g., heat rejection) component such as a fin assembly.

A switch 14, 16 in accordance with the present invention may include a back cover 52. A back cover 52 may enclose or encapsulate the various components of a switch 14, 16 secured to the frame 38. The various components 36, 38, 48, and 52, of a switch 14, 16 may be formed of any suitable material or combination of materials. Suitable materials may be selected based on one or more of durability, appearance, cost, electrical conductivity, insulating characteristics, density, heat capacity, thermal conductivity heat transfer coefficient, and the like. In selected embodiments, polymers have been found suitable for forming a rocker 36, frame 38, and back cover 52.

In certain embodiments, one or more leads 54 (e.g., wire leads) may extend away from a switch 14, 16. The leads 54 may provide locations for securing or otherwise electrically connecting a switch 14, 16 with a load 12 or other switches 16. In one embodiment, four leads 54 may extend through a back cover 52. The four leads 54 may represent a hot lead, neutral lead, ground lead, and control circuit lead.

A switch 14 in accordance with the present invention may include an air gap actuator 56. That is, in certain applications it may be desired or necessary to provide an air gap completely disconnecting a load 12 from a power source. Accordingly, by maneuvering (e.g., pulling) an air gap actuator 56, an air gap switch within a master switch 14 may be opened.

In selected embodiments, an air gap actuator 56 may be formed or enclosed within a frame 38. For example, an air gap actuator 56 may be positioned within the portion of the frame 38 surrounding or bordering a rocker 36. Accordingly, the air gap actuator 36 may be manipulated or used even when a face plate has been applied to the switch 14.

Figure 3:
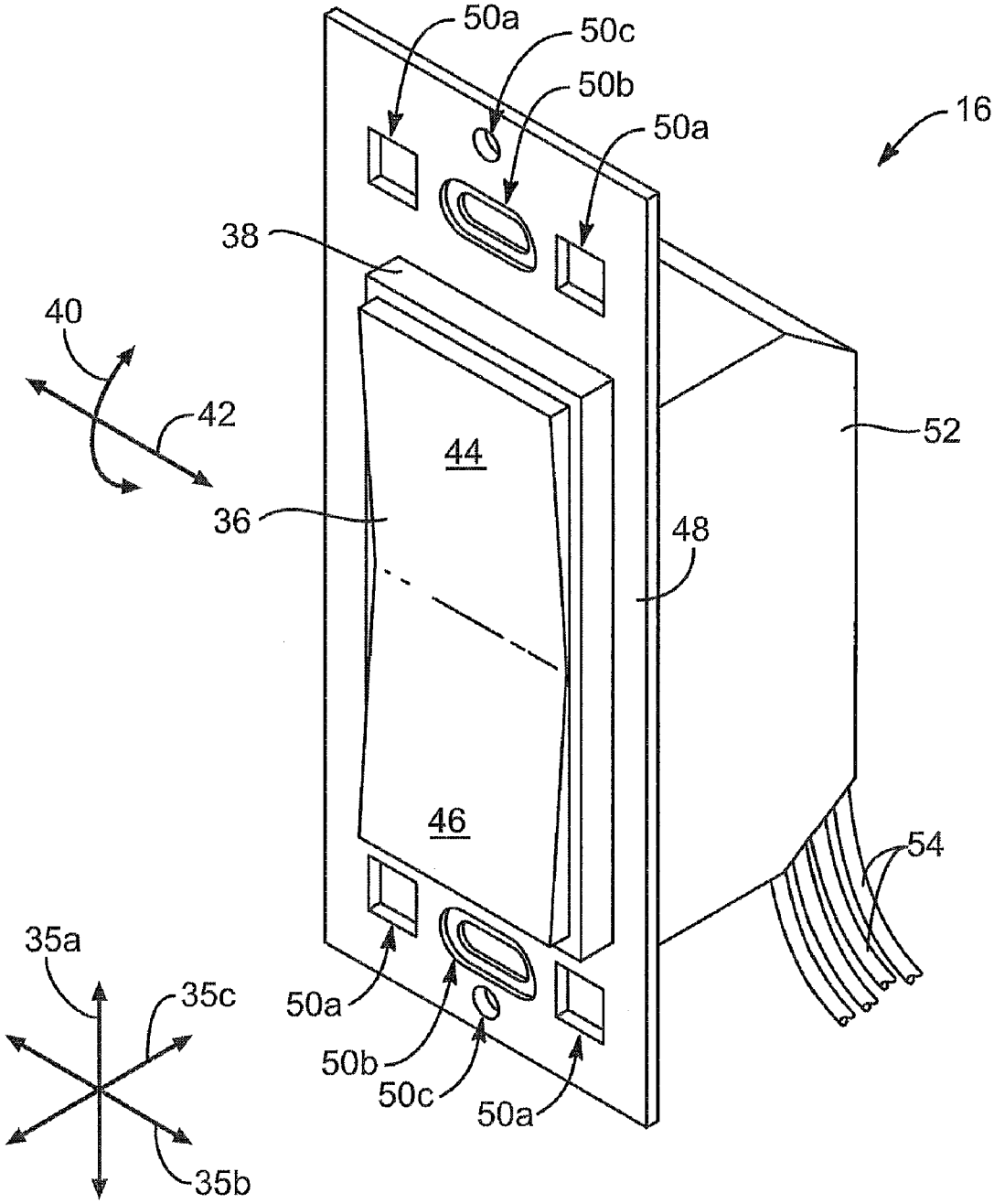
FIG. 3 is a perspective view of one embodiment of a slave switch in accordance with the present invention with the rocker in the middle of its range of motion.

Referring to FIG. 3, the components of a slave switch 16 may be significantly simpler than those of a master switch 14. For example, an air gap actuator 56 may be unnecessary or inappropriate for a slave switch 15. Additionally, a slave switch 16 may not include components generating significant heat loads (e.g., a TRIAC 22). Thus, different materials and configurations may be used in forming a slave switch 16.

For example, in selected embodiments, a flange 48 of a slave switch 16 may be a continuous, homogenous, and monolithic extension of the frame 38. That is, the frame 38 and flange 48 may be formed as a single piece without joints or seams. In certain embodiments, the frame 38 and flange 48 of a slave switch 16 may be molded of a polymer.

Figure 4:
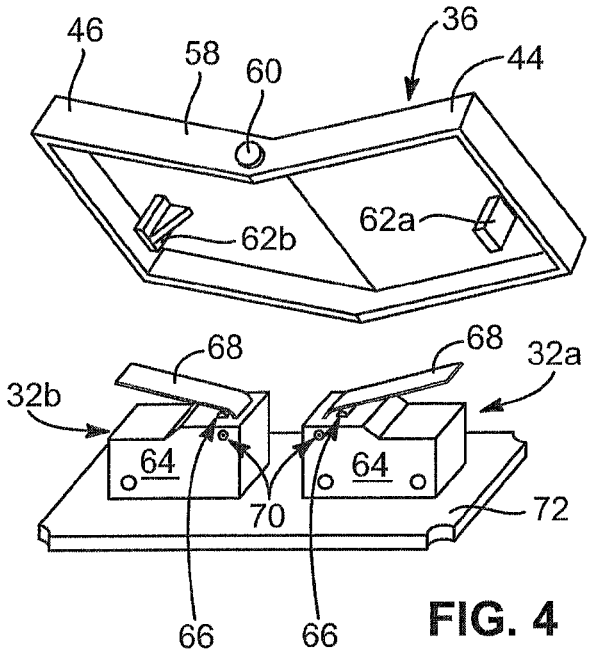
FIG. 4 is an exploded perspective view of a rocker, switches, and circuit board in accordance with the present invention.
Figure 5:
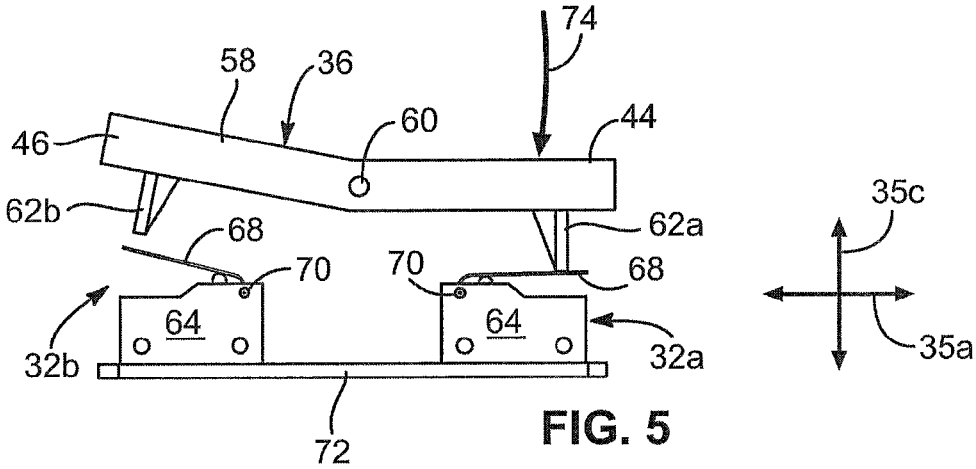
FIG. 5 is a side elevation view of a rocker, switches, and circuit board of FIG. 4 with the rocker pivoted to a first extreme of its range of motion.
Figure 6:
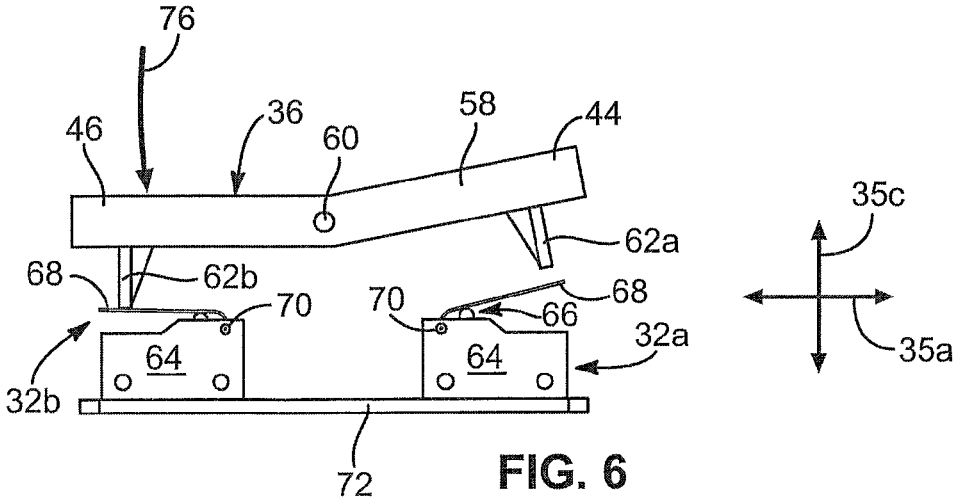
FIG. 6 is a side elevation view of a rocker, switches, and circuit board of FIG. 4 with the rocker pivoted to a second extreme of its range of motion.

Referring to FIGS. 4-6, a rocker 36 may include a border 58 or reinforced edge 58. The border 58 may increase the section modulus of the rocker 36. Additionally, the border 58 may provide a location supporting a pivot engagement 60 with the frame 38. A pivot engagement 60 may provide or define the axis 42 about which the rocker 36 pivots with respect to the frame 38. A pivot engagement 60 portion of a rocker 36 may be configured as an extension, indentation, or the like.

In selected embodiments, a rocker 36 may include one or more extensions 62. An extension 62 may extend from the underside of a rocker a selected distance to actuate a switch 32. For example, in one embodiment, a first extension 62*a* may extend from the underside of the first end 44 of a rocker 36 to actuate a first switch 32*a*. Similarly, a second extension 62*b* may extend from the underside of the second end 46 of a rocker 36 to actuate a second switch 32*b*.

The length of an extension 62 may vary between embodiments. For example, a slave switch 16 may include fewer electrical components. Accordingly, it may be possible and desirable to mount the switches 32*a*, 32*b* closer to the underside of a rocker 36. In such embodiments, the extensions 62 may be relatively short. Conversely, for switches 14 having more internal components, greater spacing and longer extensions 62 may be desired or necessary.

A micro switch 32 in accordance with the present invention may include a housing 64, an actuator 66, a lever 68, and a pivot 70. An actuator 66 may extend from the inner workings of the switch 32 and contact the underside of a lever 68. A lever 68 may pivotably connect to the housing 64 at the pivot 70. In certain embodiments, a lever 68 may extend from a pivot 70, over an actuator 66, and out over the housing a selected distance. An actuator 66 may act as an intervening fulcrum for a lever 68. Accordingly, when a lever 68 is depressed (i.e., urged toward the housing 64) a certain distance, the actuator 66 may be depressed and the switch 32 activated.

In selected embodiments, a switch 32*a*, 32*b* may be secured to a circuit board 72. The frame 38 may provide the connection between a rocker 36 and a circuit board 72. In certain embodiments, a circuit board 72 may be sufficiently rigid that actuation of the switches 32 by the rocker 36 does not cause undesirable flexing of the circuit board 72.

The range of motion of a rocker 36 may include a middle, located substantially equidistant from the first and second extremes. While a rocker 36 is at the middle location, neither switch 32*a*, 32*b* may be actuated. However, a force 74 applied to the first end 44 of the rocker 36 may cause rotation of the rocker 36 sufficient to actuate the first switch 32*a*. Conversely, a force 76 applied to the second end 46 of the rocker 36 may cause rotation 40 or pivoting 40 sufficient to actuate the second switch 32*b*.

In selected embodiments, the internal workings of a switch 32 may be such that an actuator 66 resists depression. That resistance may equate to a particular load. The lever 68 extending over the actuator 66 may effectively reduce that load (i.e., by a mechanical advantage), but increase the distance of travel necessary to actuate the actuator 66.

In certain embodiments, a lever 68 may be formed of a resilient material. Accordingly, application (e.g., by an extension 62) of a bending load to a lever 68 may cause deflection of the lever 68 before actuation of the actuator 66. In selected embodiments, that defection may be substantially elastic. Thus, if a user were to release the force 74, 76 before the bias of an actuator 66 were overcome, the lever 68 may act as a spring urging a rocker 36 away from that extreme of its range of motion.

Accordingly, the bias of an actuator 66, the resiliency of a lever 68, or some combination thereof may be considered a biasing mechanism of the corresponding switch 32. A first biasing mechanism corresponding to a first switch 32*a* may urge a rocker 36 away from the first extreme of its range of motion. Similarly, a second biasing mechanism corresponding to the second switch 32*b* may urge the rocker 36 away from the second extreme of its range of motion. Thus, collectively the first and second biasing mechanisms of the respective first and second switches 32*a*, 32*b* may bias the rocker 36 to the middle of its range of motion, substantially equidistant from the first and second extremes.

Figure 7:
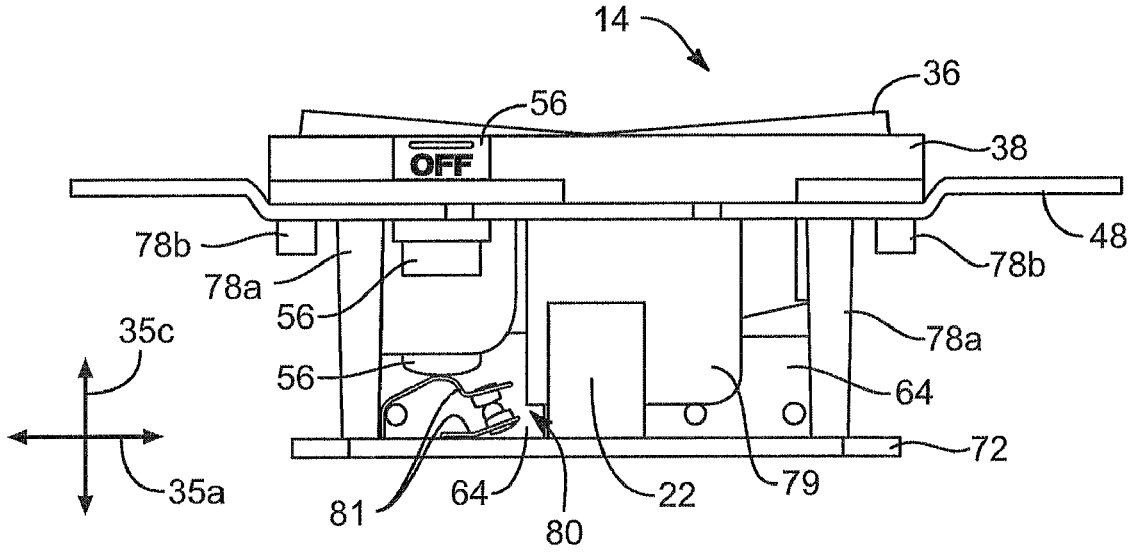
FIG. 7 is a side elevation view of one embodiment of a master switch in accordance with the present invention with the back cover removed and the air gap actuator in a stowed position.

Referring to FIG. 7, in selected embodiments, a frame 38 may include one or more extensions 78 or posts 78 extending in the transverse direction 35*c*. For example, selected posts 78*a* may extend from a frame 36 and through a flange 48 to engage a circuit board 72. Other posts 78*b* may extend from a frame 36 through a flange 48 to engage a back cover 52.

In selected embodiments, a flange 48 may include one or more apertures extending in the transverse direction 35*c* therethrough. One such aperture may be sized to permit the rocker 36 to contact or engage the various switches 32. In one embodiment, the aperture may be formed by cutting and bending to create a tab 79 extending orthogonally from the remaining portion of the flange 48. The tab 79 may extend to engage or contact certain components (e.g., a TRIAC 22) that generate excessive heat. Accordingly, heat may be removed from such components and conducted into the flange 68 where it may dissipate.

Figure 8:
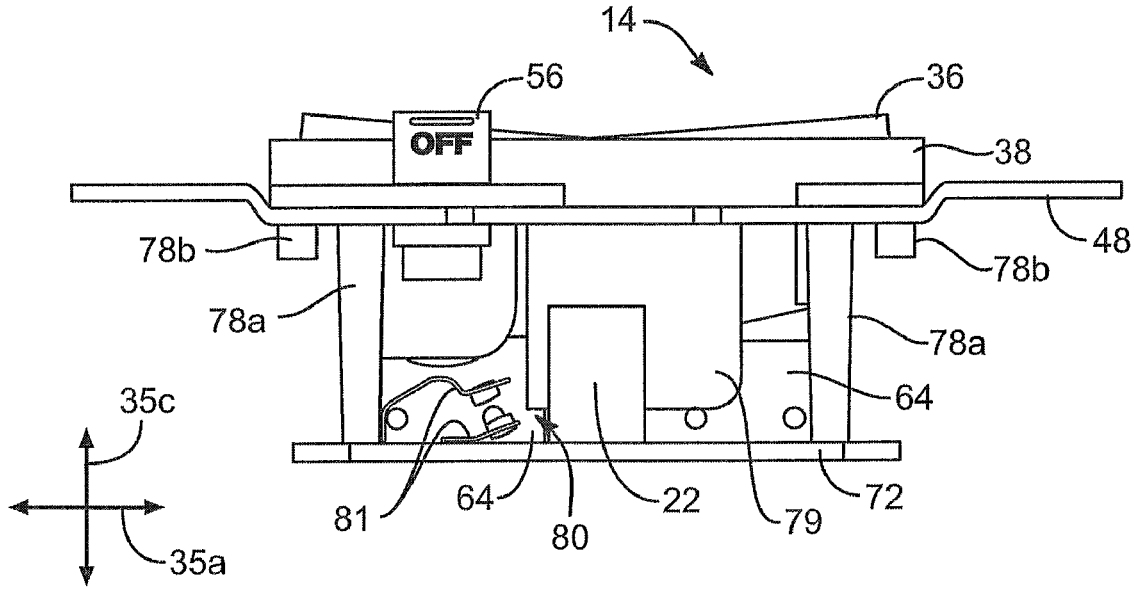
FIG. 8 is a side elevation view of the master switch of FIG. 7 with the air gap actuator in a deployed position.

Referring to FIGS. 7-8, a switch 14 in accordance with the present invention may include an air gap switch 80 cutting all power to the load 12. In selected embodiments, an air gap switch 80 may include an air gap actuator 56 and a pair of leads 81. An air gap actuator 56 may translate with respect to a frame 36 in the transverse direction 35*c*. In a stowed configuration, an air gap actuator 56 may urge contact between two leads 81. In selected embodiments, one or more of the leads 81 may be formed of a resilient material. Accordingly, withdrawal of the air gap actuator 56 may free the leads 81 to return to their respective neutral positions. The respective neutral positions of the leads 81 may be such that an appropriate air gap is formed therebetween.

Figure 9:
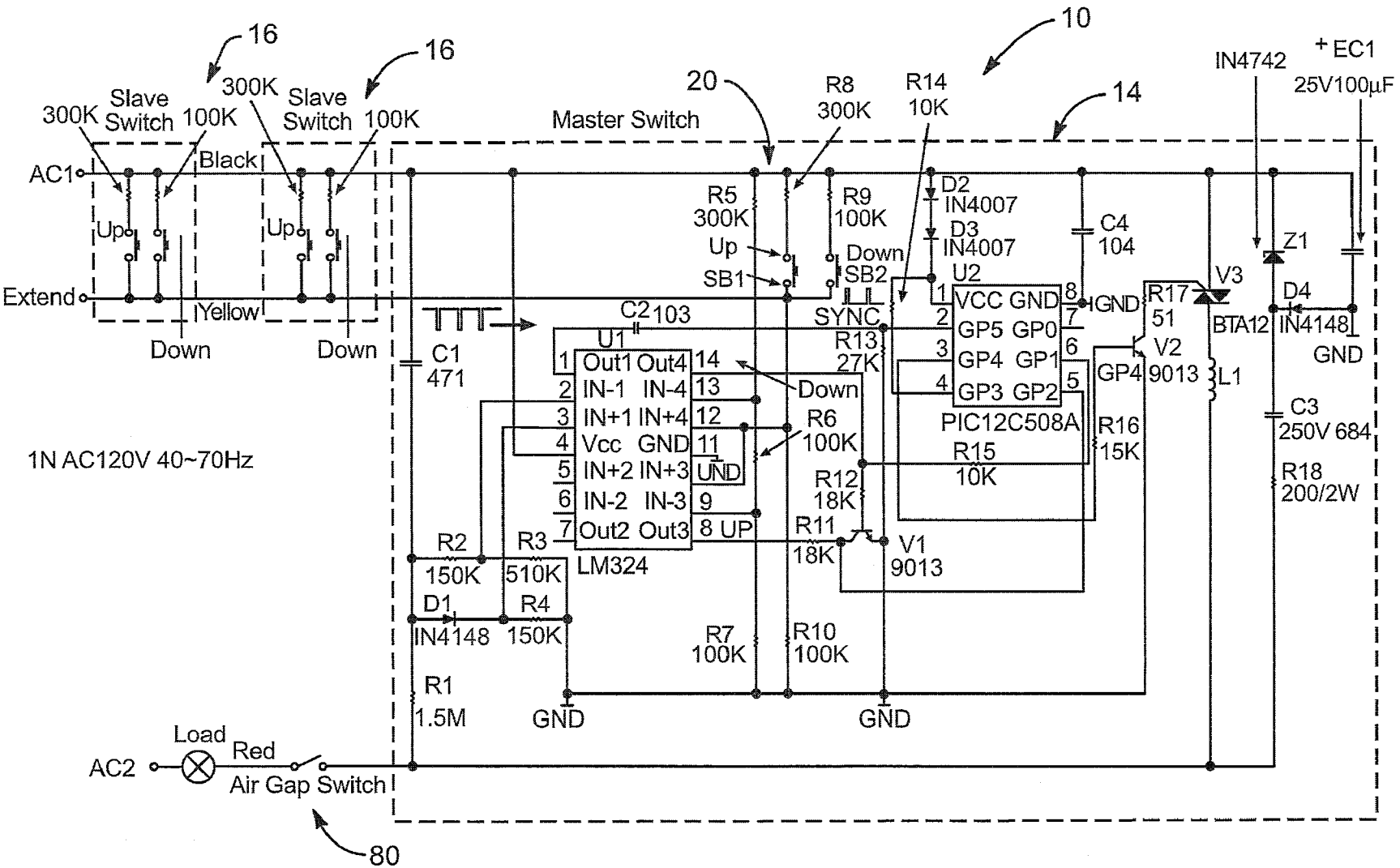
FIG. 9 is a schematic block diagram of one embodiment of the system of FIG. 1.

Referring to FIG. 9, various electrical components may be used to form a switch 14, 16 and system 10 in accordance with the present invention. Similarly, various arrangements of those components may be suitable. FIG. 9 is a schematic circuit diagram illustrating one embodiment of a system 10 in accordance with the present invention.

Figure 10:
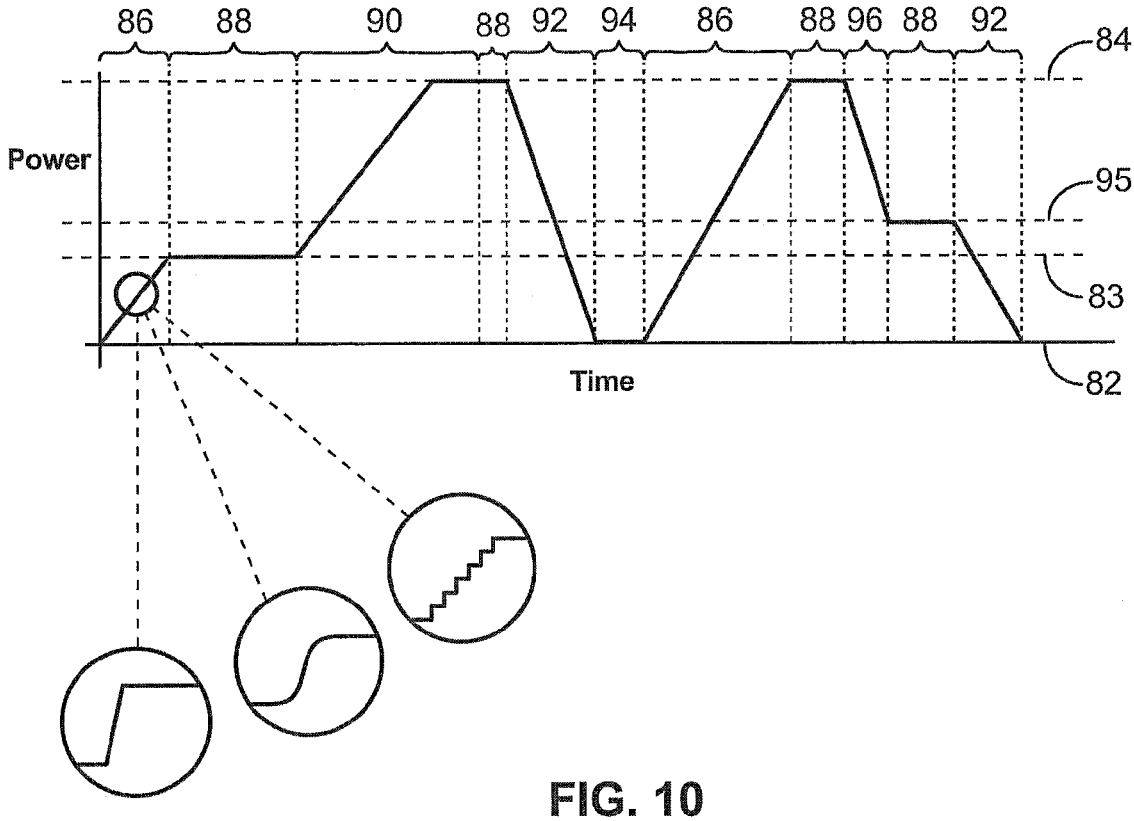
FIG. 10 is a plot of power over a period of time for the system of FIG. 1.
Figure 11:
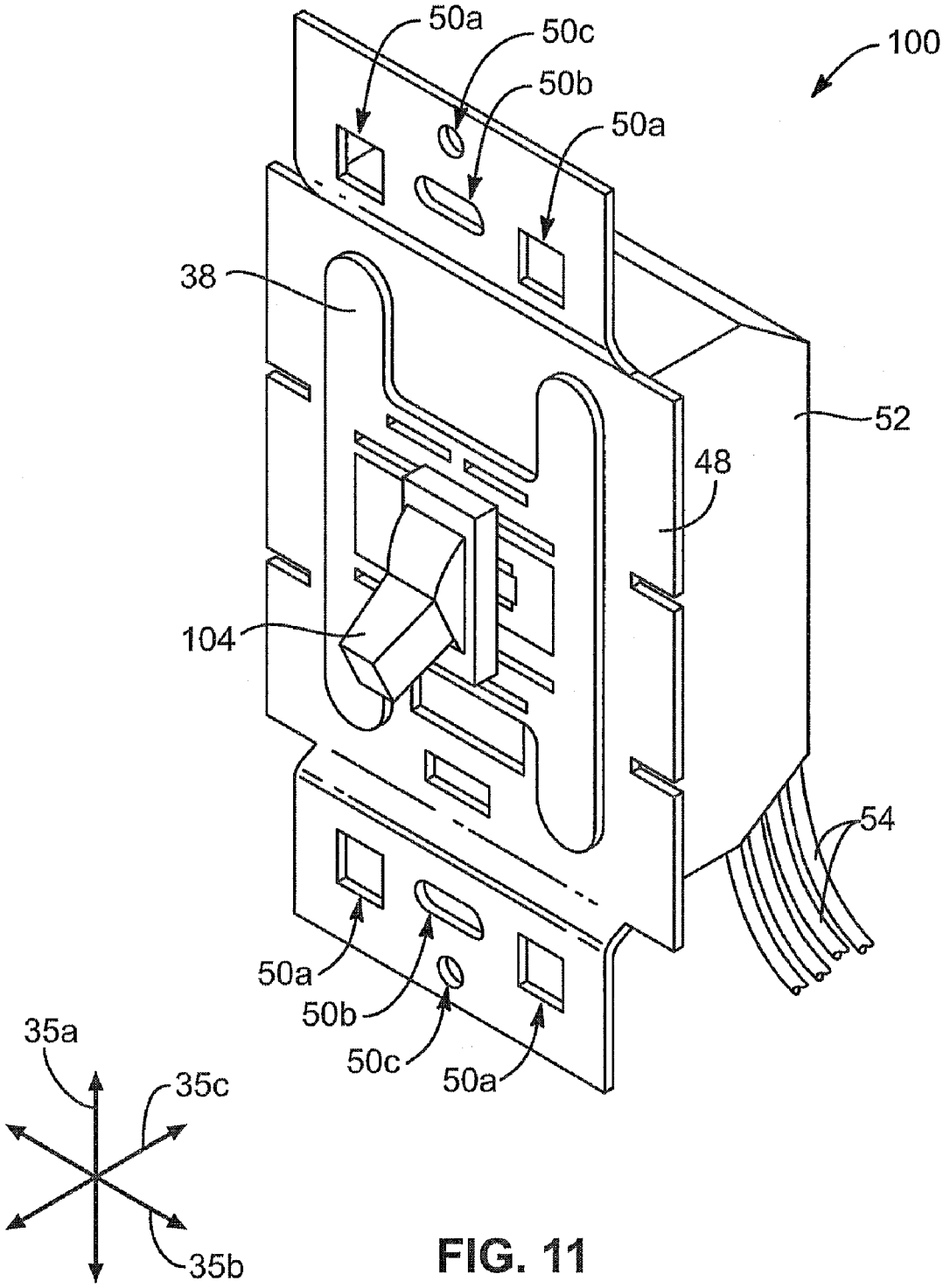
FIG. 11 is a perspective view of one embodiment of a toggle switch in accordance with the present invention.
Figure 12:
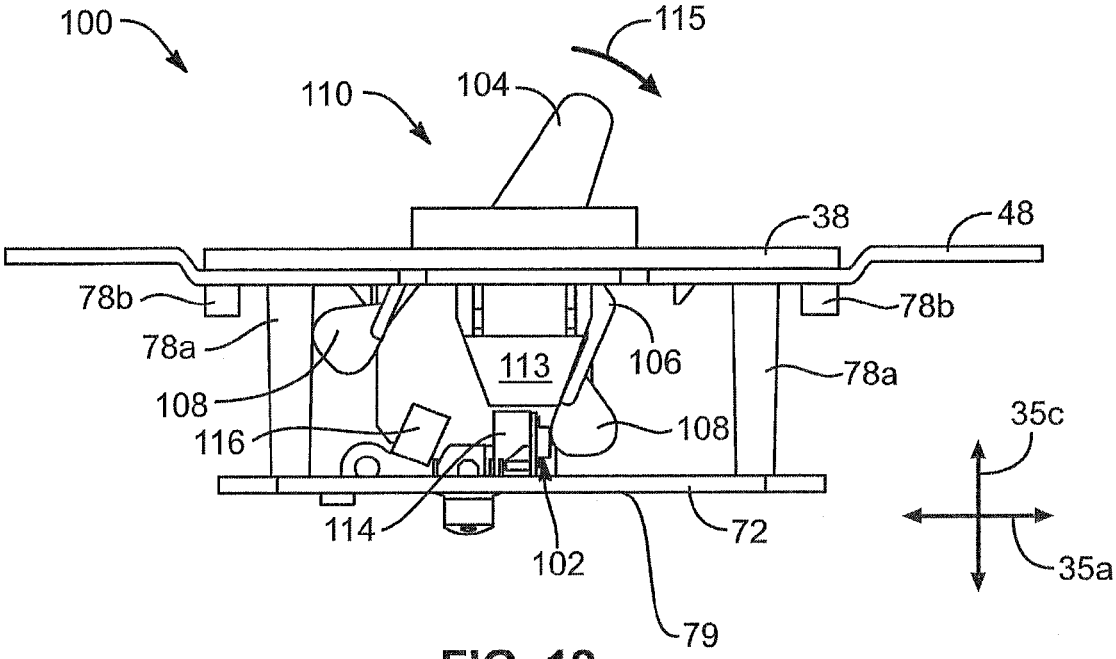
FIG. 12 is a side elevation view of the toggle switch of FIG. 11 with the back cover removed and the toggle in the first, "on" position.
Figure 13:
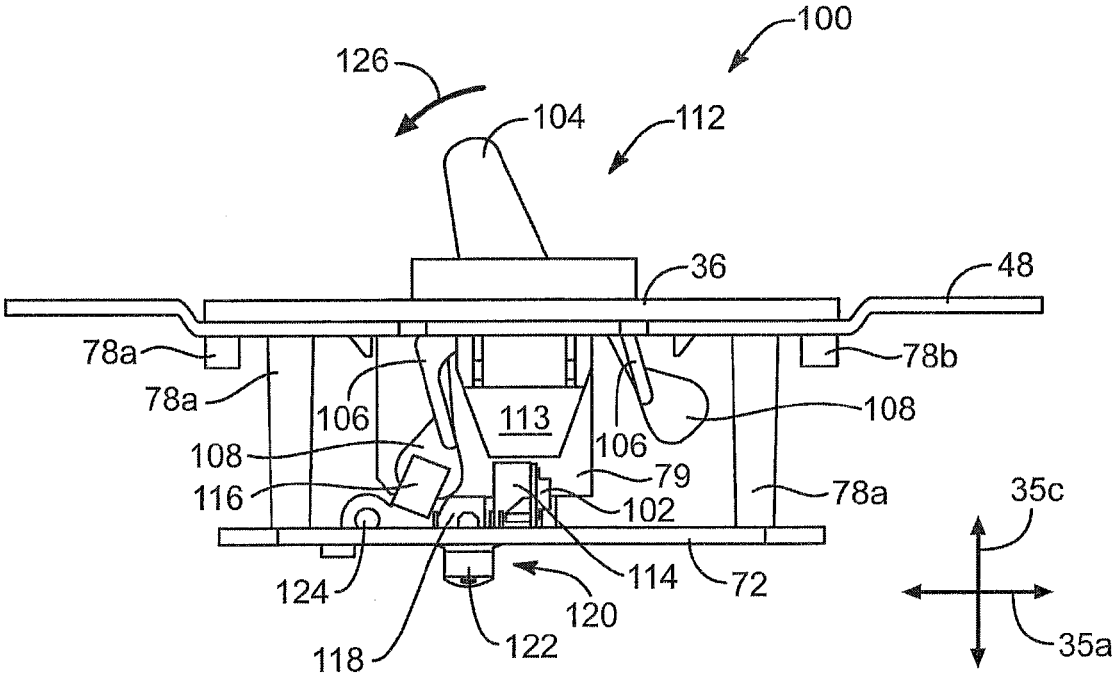
FIG. 13 is a side elevation view of the toggle switch of FIG. 12 with the toggle in the second, "off" position.
Figure 14:
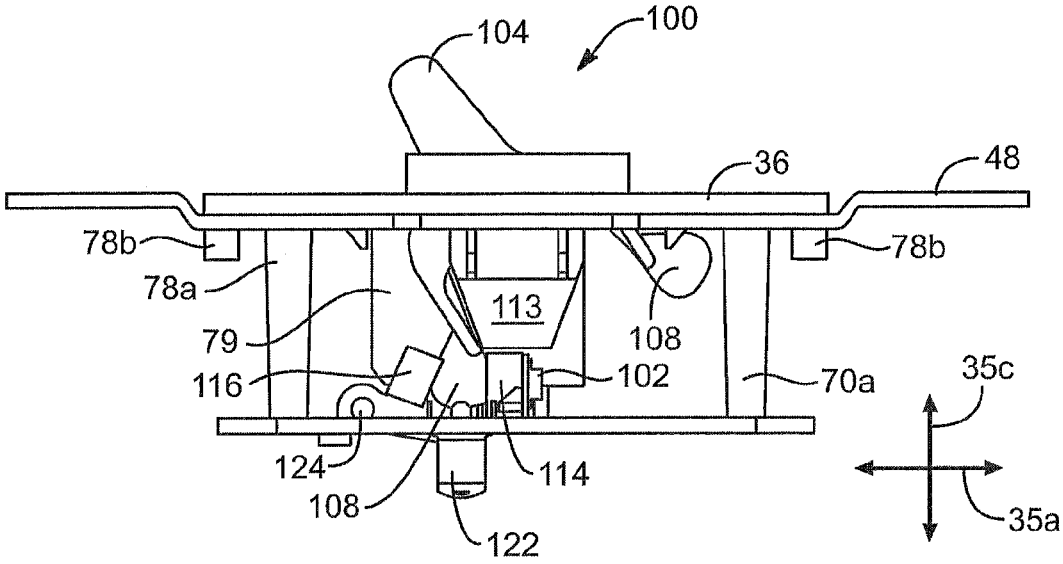
FIG. 14 is a side elevation view of the toggle switch of FIG. 12 with the toggle at the second extreme of its range of motion, thereby opening the air gap switch.
Figure 15:
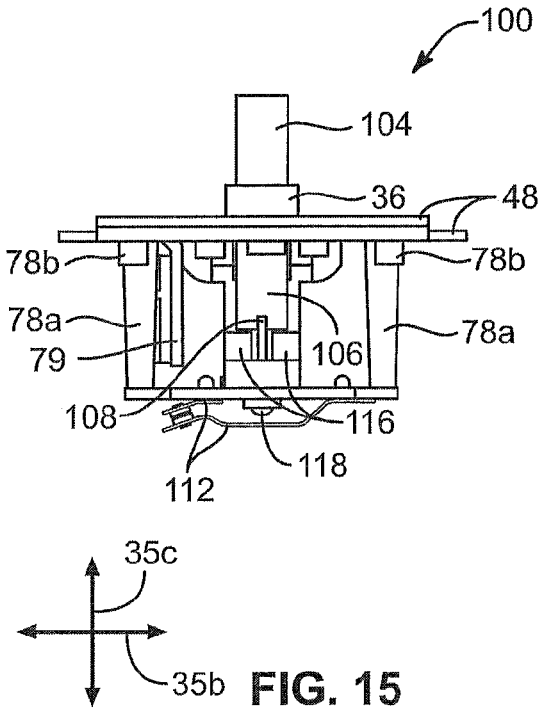
FIG. 15 is an end elevation view of the toggle switch of FIG. 13.
Figure 16:
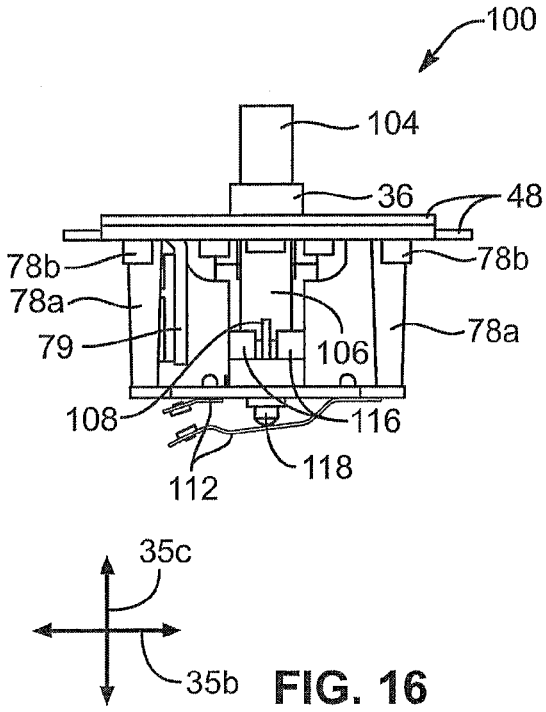
FIG. 16 is an end elevation view of the toggle switch of FIG. 14.

Referring to FIG. 10, in selected embodiments, a processor 28 maybe programmed to execute various functions, including POWER ON, BRIGHTEN, POWER OFF, and DIM functions. By plotting the power delivered over time by a system 10 in accordance with the present invention, the nature of the functions executed by a processor 28 may be revealed.

A POWER ON function may effect a transition from a zero or minimum power value 82 to an intermediate power value 83. That transition may be of any suitable form and extend over any suitable period of time 86. For example, the POWER ON function may cause a substantially instantaneous transition. Alternatively, the POWER ON function may cause more gradual transition such as a linear ramping, gradual nonlinear progression, stepped progression, and the like. Similar forms and time periods may be applied to the other functions executed by a controller (e.g., POWER OFF, BRIGHTEN, and DIM functions).

In selected embodiments, an intermediate value 83 may correspond to the state of power delivery existing immediate prior to the controller 18 executing the last, previous, POWER OFF function. Once the delivery reaches the desired level (e.g., intermediate value 83), it may be maintained thereat for as long a period 88 of time as desired by the user.

Upon pressing and holding the first end of a rocker 36, a controller 18 may execute a BRIGHTEN function. In the illustrated embodiment, the BRIGHTEN function increases the delivery of power from the intermediate level 83 to a maximum level 84. In selected embodiments, a controller 18 may continue to execute the BRIGHTEN function as long 90 as a user presses the first end 44. However, the system 10 may have and reach a maximum power delivery 84. Accordingly, additional execution of the BRIGHTEN function may not result in a greater delivery of power.

At some point, a user may decide to turn off the light 12. Accordingly, the user may press and release the second end 46 of the rocker 36. In response to such a command, a controller 18 may execute a POWER OFF function. A POWER OFF function may effect a transition from a present delivery of power at some maximum value 84 to a zero or minimum power value 82. As with the POWER ON function, the transition effected by the POWER OFF function may be of any suitable form and extend over any suitable period of time 92.

The power delivered by a system 10 in accordance with the present invention may be maintained at a minimum value 82 for any period of time 94 desired by a user. When a user again presses and releases the first end 44 of a rocker 36, the controller 18 may execute a POWER ON function, transitioning from the minimum value 82 to the value (in the illustrated embodiment, the maximum value 84) occupied immediately before the latest POWER OFF function was executed. The power may again be maintained at that level or value for a period 88 of time desired by a user.

Once a user desires to lower the power delivered to a light 12, the user may press and hold the second end 46 of a rocker 36. In response to such a command, a controller 18 may execute a DIM function. A DIM function may effect a transition from a present value (in the illustrated embodiment, the maximum value 84) to a lower value 95 selected by the user (i.e., the power level delivered at the time the user releases the second end 46). As with the other functions, the transition effected by the DIM function may be of any suitable form and extend over any suitable period of time 96. Additionally, as with the BRIGHTEN function, a controller 18 may continue to execute the DIM function as long as a user presses the second end 46. However, the system 10 may have a minimum power delivery value 82. Accordingly, additional execution of the DIM function may not result in a lower delivery of power.

After a user releases the second end 46 of a rocker 36, a controller 18 may maintain that level of power delivery for any period of time 88 desired by the user. Finally, a user may then decide to turn off the light 12 by pushing and releasing the lower or second end 46 of the rocker 36. Accordingly, the controller 18 may execute again the POWER OFF function.

A controller 18 (e.g., processor 28) may use time to differentiate between a press and release and a press and hold. For example, in selected embodiments, a processor 28 may be programmed to execute a POWER ON function after the controller 18 senses that the resistance imposed by the signal generator 20 has been substantially equal to the resistance of the first resistor 34 for a period of time less than a first time threshold. Conversely, a processor 28 may be programmed to execute a BRIGHTEN function after the controller 18 senses that the resistance imposed by the signal generator 20 has been substantially equal to the resistance of the second resistor 34 for a period of time greater than a second time threshold.

Similarly, a processor 28 may be programmed to execute a POWER OFF function after the controller 18 senses that the resistance imposed by the signal generator 20 has been substantially equal to the resistance of the second resistor 34 for a period of time less than the first time threshold. The processor 28 may be programmed to execute a DIM function after the controller 18 senses that the resistance imposed by the signal generator 20 has been substantially equal to the resistance of the second resistor 34 for a period of time greater than the second time threshold.

In selected embodiments, the first time threshold may be less than the second time threshold. In other embodiments, the first and second time threshold may be consolidated into one threshold representing a single period of time.

Referring to FIGS. 11-16, in selected embodiments, a system 10 in accordance with the present invention may include a toggle switch 100 controlling delivery of power to a load 12 (e.g., light 12). In certain embodiments, a toggle switch 100 may include a toggle 104 having extension arms 106 and paddles 108, connected to the ends of the extension arms 106.

A toggle 104 may be connected to a frame 36 to pivot through a range of motion having a first extreme and a second extreme. The first extreme may be located opposite the second extreme. A toggle 104 may also be connected to a frame 36 to toggle between a first position 110, proximate the first extreme, and a second position 112, proximate the second extreme. In selected embodiments, a toggle 104 may operate under the bias of a spring (e.g., coil spring) contained within a housing 113. The spring may create an unstable equilibrium throughout the middle portion of the range of motion of the toggle 104 and bias the toggle 104 to the first and second positions 110, 112.

In selected embodiments, a toggle switch 100 in accordance with the present invention may include a switch 114 connected to a frame 38. When toggled to the first position 110, a toggle 104 (e.g., paddle 108) may abut an actuator 102 of the switch 114. Accordingly, the location of the switch 114 may define the location of the first position 110.

In certain embodiments, the spring contained within the housing 113 may urge a toggle 104 into contact with the actuator 102 of a switch 114. However, that spring may have insufficient strength or leverage to depress the actuator 102. Accordingly, additional force 115 may be required to pivot the toggle 104 toward a first extreme of the range of motion and depress the actuator 102, activating the switch 114. Activation of the switch may initiate a CYCLE function. Once that additional force 115 is relieved or sufficiently reduced, a bias of the switch 114 may return the actuator 114 to the first position 110.

In the second position 112, an actuator 102 (e.g., paddle 108) may trigger or trip a sensor 116. In one embodiment, the sensor 116 may detect the actuator 102 in the second position without contacting the paddle 108. For example, the sensor 116 may be magnetic, optical, or the like. The sensor 116 may be connected to a controller 18. Accordingly, through the sensor 116, a controller 18 may determine whether a toggle 104 is in the second position 112. In selected embodiments, a controller 18 may include a processor 28 programmed to execute a POWER ON function whenever the sensor 116 senses that the toggle 104 has toggled out of the second position 112. Conversely, a processor 28 may be programmed to execute a POWER OFF function whenever the sensor 116 senses that the toggle 104 has toggled into the second position 116.

In selected embodiments, an air gap switch 120 may define or provide the abutment defining the second position 112. For example, an air gap switch 120 may include an actuator 118 acting between a toggle 104 (e.g., arm 106, paddle 108, or the like) and one or more leads 122. With the urging of the toggle 104, the actuator 118 may rotate 12 about a pivot 124. Movement (e.g., tilting, pivoting) about the pivot 124 may cause the actuator 118 to extend downward, thereby spacing the leads 122, or creating an air gap between the leads 122.

In certain embodiments, the abutment between an actuator 118 and a toggle 104 may provide a barrier to pivoting the toggle 104 to the second extreme of the range of motion. Accordingly, an additional force 126 may be required to advance the toggle 104 past the initial contact with the actuator 118. In one embodiment, a lead 122 may be biased toward closure and biased toward urging the actuator 118 into abutment with the toggle 104.

However, once the barrier provided by the actuator 118 has been overcome, the toggle 104 may push the actuator 118 in the transverse direction 35*c*. The actuator 118, in turn, may deflect a lead 122, causing a separation or air gap in the transverse direction 35*c* between the leads 122. In selected embodiments, to remove the toggle 104 or displace the toggle 104 from this second extreme, a force 130 may be required.

Figure 17:
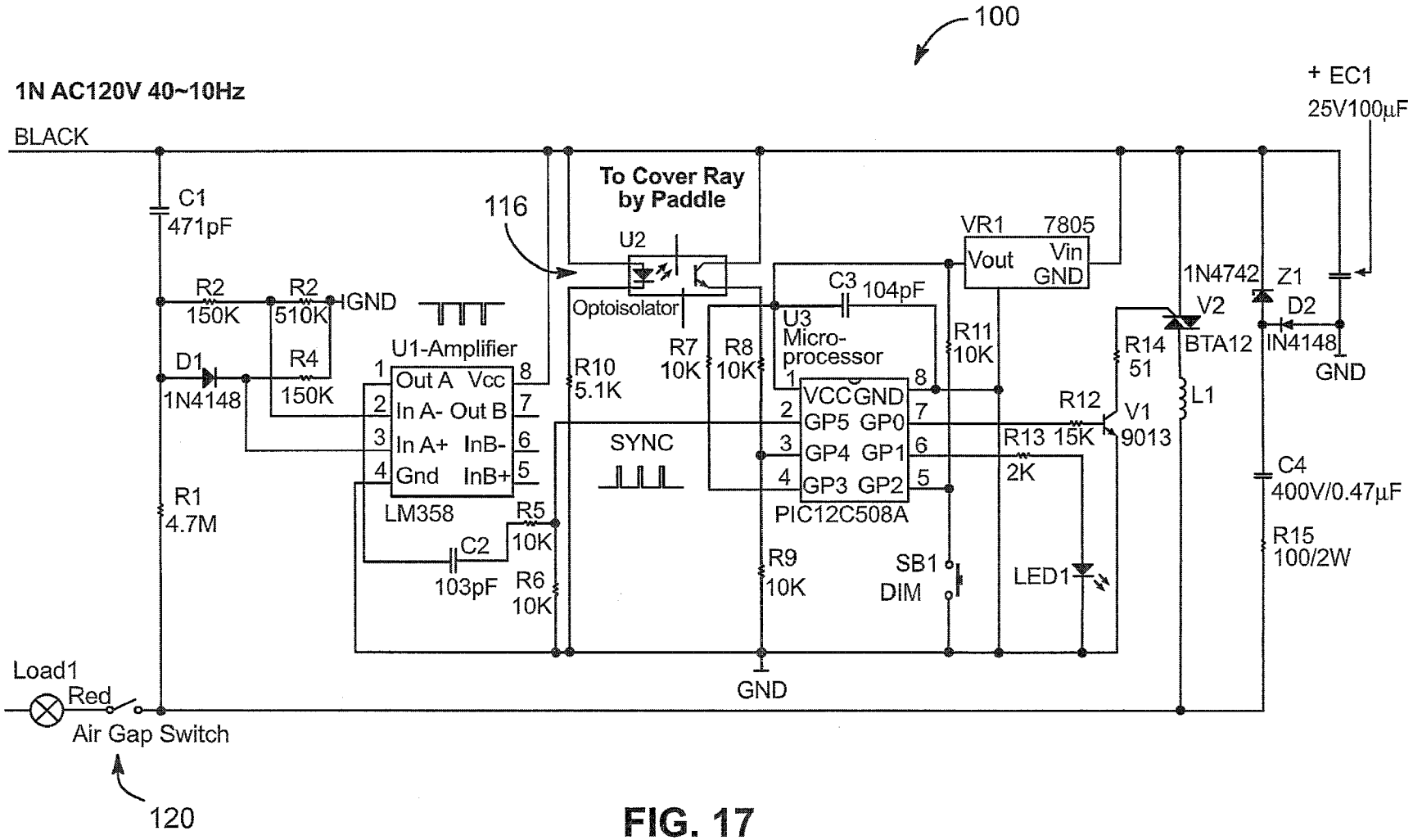
FIG. 17 is a schematic diagram of the switch of FIG. 11-16.

Referring to FIG. 17, various electrical components may be used to form a toggle switch 100 and system 10 in accordance with the present invention. Similarly, various arrangements of those components maybe suitable. FIG. 17 comprises a schematic circuit diagram illustrating one embodiment of a system 10 in accordance with the present invention.

Figure 18:
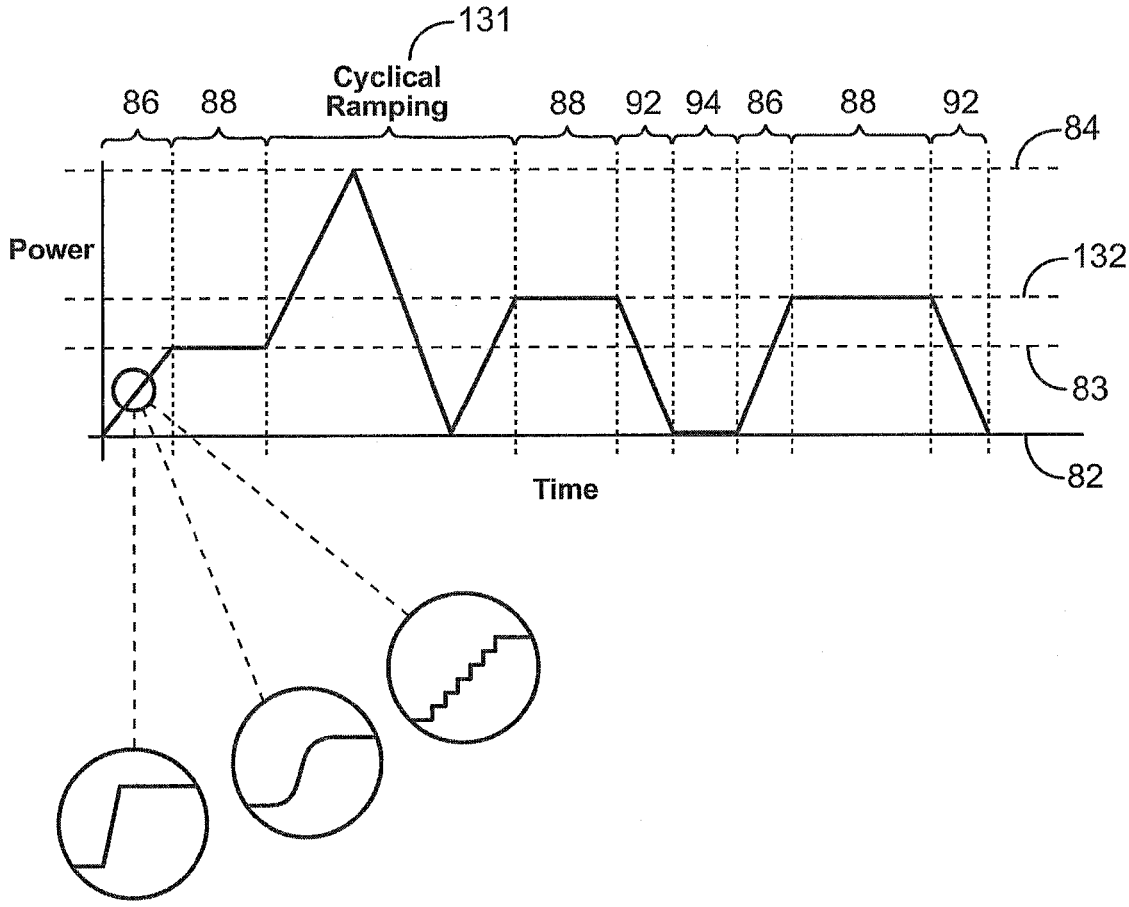
FIG. 18 is a plot of power over a period of time for the switch of FIG. 11-16.

Referring to FIG. 18, the power delivered over time by a toggle switch 100 may be charted or plotted. In selected embodiments, a processor 28 corresponding to a toggle switch 100 may be programmed to execute various functions, including POWER ON, POWER OFF, and CYCLE functions. By plotting the power delivered over time by a system 10 in accordance with the present invention, the nature of the functions executed by a processor 28 may be revealed.

A POWER ON function may effect a transition from a zero or minimum power value 82 to an intermediate power value 83. That transition may be of any suitable form and extend over any suitable period 86 of time. Similar forms and time periods may be applied to the other functions executed by a controller (e.g., POWER OFF and CYCLE functions).

To initiate a CYCLE function, a user may press or urge a toggle 104 past the first position 110 toward the first extreme of the range of motion of the toggle 104. The CYCLE function may provide a cyclical ramping 131 from or through a maximum power delivery and a minimum power delivery.

For example, in the illustrated embodiment, a user has initiated a CYCLE function, which proceeded to ramp the power up to a maximum power delivery 84. Once the maximum power delivery 84 was been reached, the CYCLE function continues by reducing the power delivery until a minimum power delivery value 82 is reached. Upon reaching the minimum current delivery, a CYCLE function may then again increase the power delivery.

At any point within the cyclical increases and reductions (i.e., continues between extremes, but alternatively being stepped incrementally) implemented by a CYCLE function, a user may release the toggle 104. Releasing the toggle 104 may deactivate the switch 114, causing the processor 28 to exit or cease the CYCLE function. The processor 28 may then maintain the power delivery at the level 132 provided immediately prior to the cessation of the CYCLE function. The delivery of current may be maintained at that level for any specified period of time 88 selected by a user.

When the toggle 104 is switched to the second position 112 or "off" position 112, a controller 18 may execute a POWER OFF function, transitioning the power delivery from the current level to a minimum level 82. In selected embodiments, when the toggle 104 is again returned to the first position 110, the controller 18 may transition the power delivery to the previously occupied level. That level may be maintained by the controller 18 until a user readjusts the delivery of power or instructs the toggle switch 100 to execute a POWER OFF function.

The present invention may be embodied in other specific forms without departing from its operating principles or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A switch for controlling delivery of electrical current to a light, the switch comprising:

a frame;

a controller connected to the frame;

a toggle connected to the frame to pivot through a range of motion having a first extreme and a second extreme, opposite the first extreme, and to toggle between a first position proximate the first extreme and a second position proximate the second extreme;

a sensor connected to the frame and positioned to detect the toggle in the second position;

a tactile switch connected to the frame and positioned to be actuated by the toggle pivoting past the first position toward the first extreme; and the controller connected to the sensor and tactile switch to receive inputs therefrom and to execute logic to control the delivery in accordance with the inputs.

2. The switch of claim 1, wherein the controller comprises a processor programmed to execute a POWER ON function whenever the sensor senses that the toggle has toggled out of the second position and a POWER OFF function whenever the sensor senses that the toggle has toggled into the second position.

3. The switch of claim 2, wherein the processor is further programmed to execute a DIM function upon activation of the tactile switch, the DIM function progressing the delivery through a repeating pattern comprising cycling between delivery of a maximum electrical current and delivery of a minimum electrical current.

4. The switch of claim 3, wherein the processor is further programmed to exit the DIM function upon deactivation of the tactile switch.

5. The switch of claim 4, wherein the processor is further programmed to maintain the delivery at a first value corresponding to a first state existing immediately prior to the controller exiting the last, previous, DIM function.

6. The switch of claim 5, wherein the POWER ON function comprises returning the delivery to a second value corresponding to a second state existing immediately prior to the controller executing the last, previous, POWER OFF function.

7. The switch of claim 6, wherein the sensor is a sensor that detects the presence of the toggle in the second position without contacting the toggle.

8. The switch of claim 7, wherein the tactile switch is a push-to-make switch.

9. The switch of claim 8, further comprising an air gap switch connected to the frame and positioned to be actuated by the toggle pivoting past the second position toward the second extreme.

10. The switch of claim 9, wherein the air gap switch is a push-to-break switch.

11. The switch of claim 1, wherein the controller comprises a processor programmed to execute a DIM function upon activation of the tactile switch, the DIM function progressing the distribution through a repeating, cyclical pattern comprising a maximum distribution of electrical current and a minimum distribution of electrical current.

12. The switch of claim 11, wherein the processor is further programmed to exit the DIM function upon deactivation of the tactile switch.

13. The switch of claim 12, wherein the processor is further programmed to maintain the distribution at a first value corresponding to a first state existing immediately prior to the controller exiting the last, previous, DIM function.

14. The switch of claim 13, wherein the POWER ON function comprises returning the delivery to a second value corresponding to a second state existing immediately prior to the controller executing the last, previous, POWER OFF function.

15. The switch of claim 1, wherein the sensor is a sensor that detects the presence of the toggle in the second position without contacting the toggle.

16. The switch of claim 1, wherein the tactile switch is a push-to-make switch.

17. The switch of claim 1, further comprising an air gap switch connected to the frame and positioned to be actuated by the toggle pivoting past the second position toward the second extreme.

18. The switch of claim 17, wherein the air gap switch is a push-to-break switch.

* * * * *